US005775571A

United States Patent [19]

Edelman

[11] Patent Number: 5,775,571

[45] Date of Patent: Jul. 7, 1998

[54] AUTOMATIC POP UP, BULK BIN, MULTI-SIDED CONTAINER APPARATUS

[75] Inventor: Frederick E. Edelman, Yardley, Pa.

[73] Assignee: Art Kraft Container Corporation, Tullytown, Pa.

[21] Appl. No.: 703,004

[22] Filed: Aug. 26, 1996

[51] Int. Cl.[6] ..... B65D 5/12

[52] U.S. Cl. ..... 229/108.1; 229/110; 229/117.06

[58] Field of Search ..... 229/117, 117.06, 229/108.1, 110

[56] References Cited

U.S. PATENT DOCUMENTS

| | | | |
|---|---|---|---|
| 1,792,370 | 2/1931 | Goodman . | |
| 2,019,787 | 11/1935 | Leopold . | |
| 2,271,962 | 2/1942 | Weiner . | |
| 4,341,337 | 7/1982 | Beach, Jr. et al. | 229/117.06 |
| 5,445,315 | 8/1995 | Shelby | 229/117.06 |

FOREIGN PATENT DOCUMENTS

| | | |
|---|---|---|
| 158551 | 8/1954 | Australia . |

*Primary Examiner*—Stephen P. Garbe
*Attorney, Agent, or Firm*—Woodbridge & Associates

[57] ABSTRACT

A bulk bin, multi-sided container includes a bottom portion with tabs that automatically pops into position when the container is erected from the flat state. The container preferably includes a sidewall section having six panels which is attached to a bottom section having six sides with six tabs therein. Two of the tabs of the bottom section are attached adhesively to cut-out portions on the bottom inside of two opposing panels of the sidewall section in such a fashion that a portion of the tabs adjacent to the attached tabs lie inside of the multi-sided container when the container is in the flat state. This structure automatically forces the remaining nonattached tabs to pop into proper alignment and position when the extreme edges of the flat sidewalls are squeezed towards each other. A top having a similar structure can be erected quickly and placed on top of the container. The container and its top can be erected in a matter of seconds. Even though the remaining tabs are not physically attached to the sidewalls, nevertheless they form very satisfactory bulk bin containers which may be stacked on pallets for storage of bulk materials such as granular plastic resins, and the like.

6 Claims, 9 Drawing Sheets

AUTOMATIC POP UP, BULK BIN, MULTI-SIDED CONTAINER APPARATUS

BACKGROUND OF THE INVENTION

1. Field of the Invention

The invention relates to a bulk bin, multi-sided container which can be easily erected from the flat state.

2. Description of Related Art

The folding corrugated container art is fairly well developed, yet to date there is no truly satisfactory pop up container suitable for use for storing granular materials such as chemical resins and for subsequently stacking on pallets and with other containers for the purpose of transportation or warehousing.

Standard multi-sided, semi-bulk containers have a number of common characteristics and advantages.

Standard multi-sided containers generally exhibit superior strength. Typical compression test data confirms that a multi-sided container provides between 30–50% greater strength, board for board, than does a rectangular configuration. The greater performance level allows a number of significant benefits including: decreased usage of paper to achieve the same results as a rectangle; inherent increased performance permitting the totes to be stacked higher if there is space available for an equal amount of paper used; heavier weights can be contained in the totes than is currently possible with rectangles or squares; and, there is a greater margin of safety during stacking and shipping, especially under adverse conditions that normally occur during the summer months.

Standard multi-sided containers also exhibit greater flexural rigidity. There is a significant increase in sidewall flexural rigidity, i.e. resistance of the sidewall to bending and flexing under load, which in combination with the superior compression performance of multi-sided containers, renders the maximum possible performance for the minimum amount of material in use. This improved resistance is a result of individually shorter panels, which produces a reduced horizontal load per square inch of panel size.

Standard multi-sided containers reduce material usage. For example, material usage is reduced by the elimination of a top flange which decreases the total square footage by approximately 7–8% when compared to a container that requires a flange top. A top flange is rendered unnecessary because multi-sided containers exhibit superior resistance to bulge when compared to a rectangular container.

Standard multi-sided containers are also easier to fill and handle. Elimination of the top flange, which normally needs to be folded down and interlocked, eliminates a potential cause of CTS (Carpal Tunnel Syndrome) as well as speeding up the overall set up process. It is generally easier to fill a multi-sided container completely since the entire top surface is exposed (i.e., top flanges on prior art containers hide from view part of the material) allowing for movement of material fully into all comers of container. The more completely filled a container is, the greater its strength and the lower the possibility of void corners. Void corners not only decrease the maximum possible compression yield, but provide an air pocket which collects and traps moisture causing accelerated deterioration, and ultimately sudden and premature failure of the container. The more sides a container has, the more completely it will be filled with flowable material. In theory a circle is the ultimate container in the sense that it is the most easily filled with flowable material. Therefore, the more sides a container has and the less severe the angle of the side panels are with respect to each other, the easier it fills. In other words, with less severe angles (30, 40, or 60 degrees compared to 90 degrees for a rectangle) material flow is enhanced and the material is more evenly disbursed fully into all corners. Elimination of a top flange also results in the following additional performance benefits:

1. Without the top flange it is easier to position the laminated components in near perfect alignment thereby resulting in increased strength (part of which is included in the overall 30–50% performance increase) since all components of the container are sharing the load distribution equally;
2. A flange allows the score to "roll" under pressure and reduces the columnar stacking strength (again a part of the overall 30–50% performance) of the laminated container, since the inner liner is not positioned perfectly at the score to allow for the flanges to be folded down; and,
3. Eliminating the top flange allows the top cap to fit flush with the top of the container, whereas a typical prior art top flange raises the cap by 2–3 inches because it is impossible to get the flanges to lay flat, and may even require further labor and cost to tape the flanges down in order to keep them in place.

Standard multi-sided containers are easier and more efficient to warehouse. The increased strength of a standard multi-sided container allows for higher stacking for longer periods of time which translates into reduced warehousing costs per square foot, as well as a greater margin of safety.

Lastly, standard multi-sided containers have a substantially lower impact on the environment. Specifically they require less paper, approximately 25–30% less square footage per container, which results in the following benefits: less pressure on already strained land fills; less paper required to be delivered to converters thereby reducing fuel and handling costs; less paper produces a lighter container, which in turn means easier handling and lower possibility of injury while handling, moving, and positioning containers on palettes; and, less paper means that the ultimate customer has less waste to dispose of.

In general multi-sided, semi-bulk containers are currently available in several styles and in an assortment of board combinations such as: double wall, triple wall, double wall/double wall, double wall/triple wall, triple wall/triple wall, etc. They typically take between 1–2 minutes per container to set up, require two people to accomplish the task, and generally, for best results, employ elaborate automated assembly equipment or, at the minimum, a jig apparatus.

A common type of multi-sided, semi-bulk container currently in use is the poultry style container. It typically has no top flange, is formed from a single piece die cut or rotary slotter, employs complex interlocking bottom flaps, and usually requires a bottom pad to be inserted. The bottom flaps are generally of the same test and thickness of the outer portions of the container, however, which results in a waste of board since the bottom flaps contribute very little, if anything, to the structural integrity of the container. Also since the bottom flaps do not meet, except in some specific sizes, a portion of the bottom of the container is exposed, thereby requiring the addition of the pad previously described. In most cases, at a minimum, a jig apparatus is required to efficiently assemble the container and set up time usually is in the neighborhood of 1–2 minutes and, for best results, two persons are normally required. Such containers tend to have bulges at the bottom as the die cut bottom tries to separate.

Another common type of multi-sided, semi-bulk container is the type that includes a tube sidewall and a top and bottom cap. Such structures usually have no top flange, but typically require a bottom flange. Additionally, two die cut caps need to be hand assembled for each container. In most cases a jig apparatus is required to efficiently assemble the container and set up time is normally in the range of 1–2 minutes, with two people required for most efficient results. The resulting container is prone to bulging at the bottom since there is nothing to tie the bottom together. The only restraint for the bottom of the tote is the die cut cap, which typically provides little retention. In some cases metal or plastic strapping must be used to retain the bottom of the tote or, in the alternative, a special pallet is required.

Another common style of multi-sided, semi-bulk container currently in use is the automatic tube which includes caps glued at the top and bottom of the tote. Such a structure requires no top or bottom flange but does require two caps per tube. It also necessitates the use of highly automated and complex, and expensive, assembly equipment, although only one machine operator may be necessary. The resulting structure tends to be prone to bulging, but generally not as much as other structures because the weight is typically limited to 1000–1200 lbs. per tote. Because the top and bottom are formed and glued to the top and bottom of the tote, once the top cap is torn off or cut open, it can no longer be adequately resealed if necessary unless a new cap is installed and glued on. It is also a very difficult structure to collapse once emptied due to the rigidity of the glued bottom cap which must be cut off or torn off in order to allow the unit to be knocked down.

While some of the prior art container structures go back many years, most of them are not addressed towards structures which are especially suitable for the storage of bulk materials.

Perhaps most representative of the prior art patent literature is U.S. Pat. No. 1,792,370 entitled FOLDABLE BOX BODY and issued on Feb. 10, 1931 to Rose Goodman. That patent describes a hexagonal box formed from rectangular blank sidewalls and a separate hexagonal blank bottom. The bottom opposed flaps are glued to opposite sidewalls. The flaps associated with each of the other edges of the bottom are also glued to associated sidewalls. The bottom is then folded inward relative to the sidewalls when the container is folded flat.

U.S. Pat. No. 2,271,962 entitled BOX was issued on Feb. 3, 1942 to David Weiner. The structure is similar to U.S. Pat. No. 1,792,370 previously discussed except that it incorporates a brace structure.

U.S. Pat. No. 4,341,337 entitled POLYGONAL PAPERBOARD DRUM was issued on Jul. 27, 1982 to Ralph L. Beach, Jr. and William R. Fuson. That patent describes a container having an integral sidewall/bottom blank which ultimately becomes a hexagonal box. The flaps, on the edges of the bottom, however, do not extend up into the confines of the sidewall portion of the blank.

U.S. Pat. No. 2,019,787 entitled KNOCKDOWN BOX was issued on Nov. 5, 1935 to Samuel N. Leopold. A hexagonal container is described including an integral bottom which is folded inward. In the knock-down state, however, the container appears to be entirely flat and not ready for pop up erection. In addition, it appears that the tabs on the bottom portion do not include a part that is always inside of the bottom section of the container thereby guiding the tabs into an erected state.

Lastly, Australian Patent 158,551 accepted on Aug. 30, 1954 and entitled IMPROVED COLLAPSIBLE BOX was issued to Quality Boxes Pty. Limited of Waterloo, New South Wales, Australia. That patent describes a hexagonal box including a scored bottom panel which is secured integral with the bottom edges of the mid-section of opposed sidewall strips. Integral gussets are positioned between the bottom and sidewall strips and partially, adhesively secured to the sidewall strips so that the bottom is guided with respect to the sidewalls during relative movement. In the flattened condition, however, the bottom is folded inward not outward. In contrast to the present invention, the gussets could not be folded over and attached to the sidewalls.

In summary, insofar as understood, none of the prior art appears to teach or describe a bulk bin container having a sidewall, bottom and tab structure, such as disclosed herein, which permits the container to be rapidly erected from a flat state so that it can be employed to store bulk chemicals and the like and stacked upon other similar containers for warehouse or transportation purposes.

SUMMARY OF THE INVENTION

Briefly described, the invention comprises a multi-sided bulk bin container which can be easily erected from a stored flat state. The base of the structure includes a sidewall section having six panels. A bottom having six edges includes six tabs of similar shape attached to each of the six edges, respectively. Two of the tabs are received respectively in partial, cut-out, inside facing sections of two opposed sidewall panels and attached adhesively or, alternatively, glued directly to the inside of the inner wall. The cut-out portions are important because they align a portion of the two tabs adjacent to the attached tabs so that they lie inside of the sidewall section when the container is in the flat state. It is only necessary for the user to either throw the knocked down container on the ground or to squeeze the two extreme edges of the flat sidewalls together in order for the bottom to automatically pop into position in proper alignment for use. Because the container is employed primarily for storing bulk, granular materials, such as chemical resins, it is not necessary to attach the four remaining tabs of the base to four remaining unsecured sidewall panels. A top or cap having a similar structure is automatically erected in a like fashion and placed on top of the container to form a lid or standard caps can be used. The structure is preferably formed from heavy duty, multi-ply corrugated material and is well suited for stacking on pallets, three or four containers high. Needless to say, the container can be erected in a matter of seconds. When the contents of the container are emptied, the container can be collapsed quickly and stored in the flat state for subsequent reuse.

The invention will be more fully understood by reference to the following drawings.

DETAILED DESCRIPTION OF THE INVENTION

During the course of this description, like numbers will be used to identify like elements according to the different figures that illustrate the invention.

Figure 1:
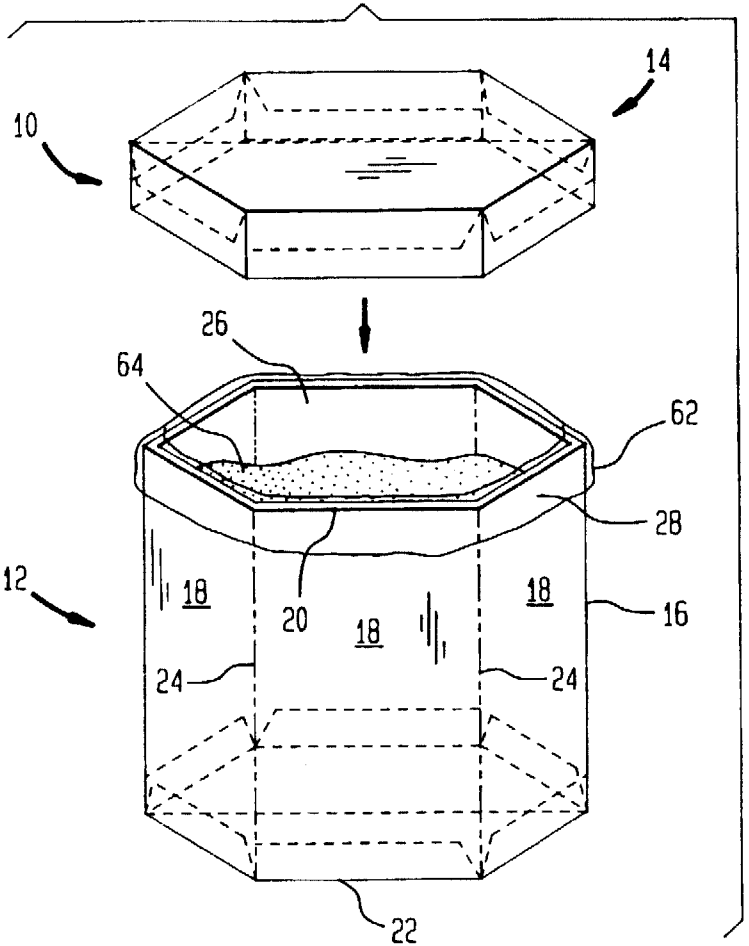
FIG. 1 illustrates the bulk bin, multi-sided container invention including the base section and cap portion in their erected state according to the preferred embodiment of the invention.
Figure 3B:
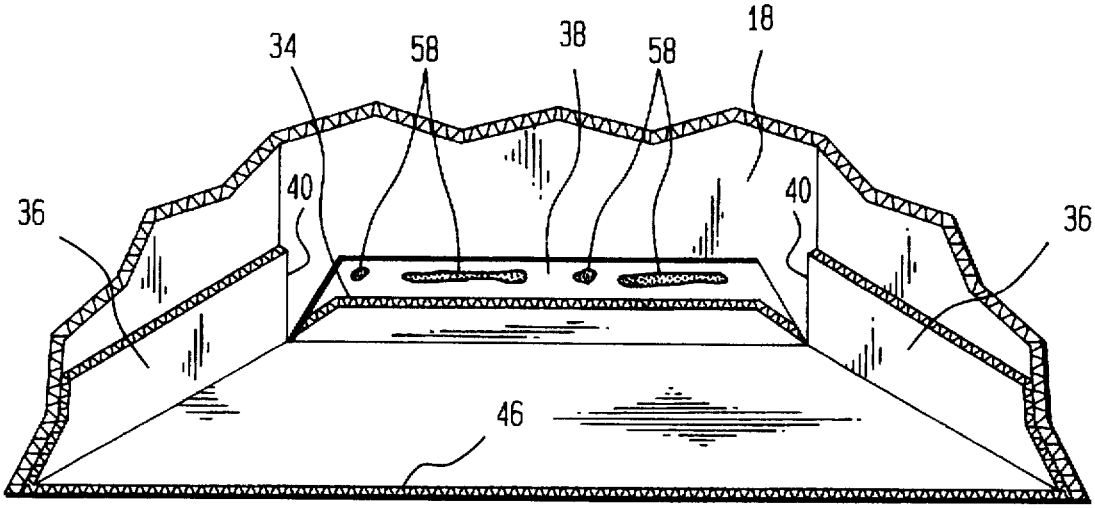
FIG. 3B is another detailed cross-sectional view of the bottom of the container illustrating the manner in which two of the tabs are received in two, partially cut-out sections of the inside of the bottom of two opposed sidewall panels of the base section.
Figure 3A:
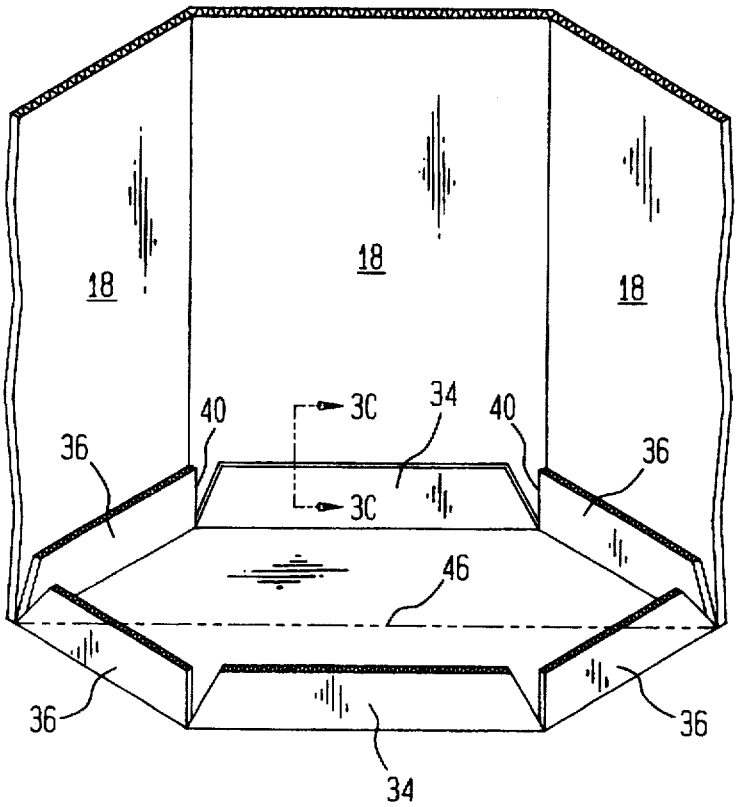
FIG. 3A is a partial cross-sectional view of the bottom of the base section of the container illustrating the manner in which the tabs automatically pop into position into the sidewall of the base section, when erected.
Figure 3C:
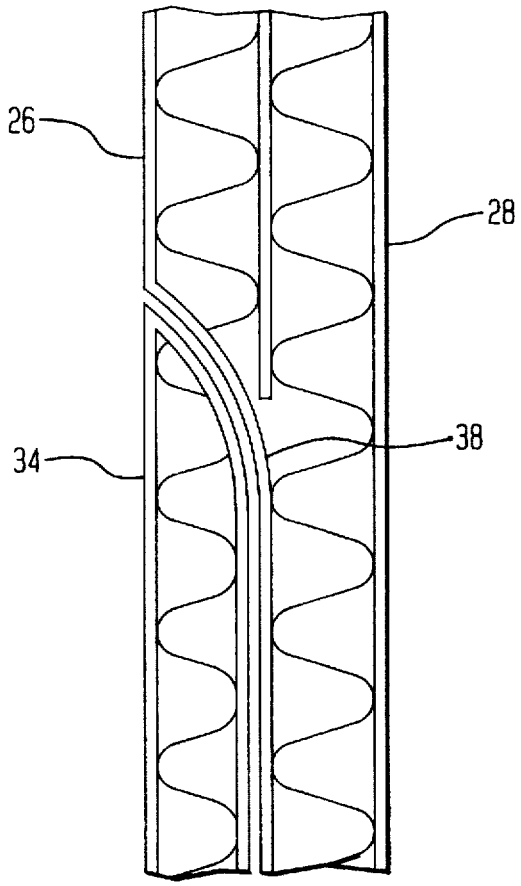
FIG. 3C is a cross-sectional, detail view of a portion of the tab attachment area shown in FIG. 3A as seen from perspective 3C—3C.
Figure 4A:
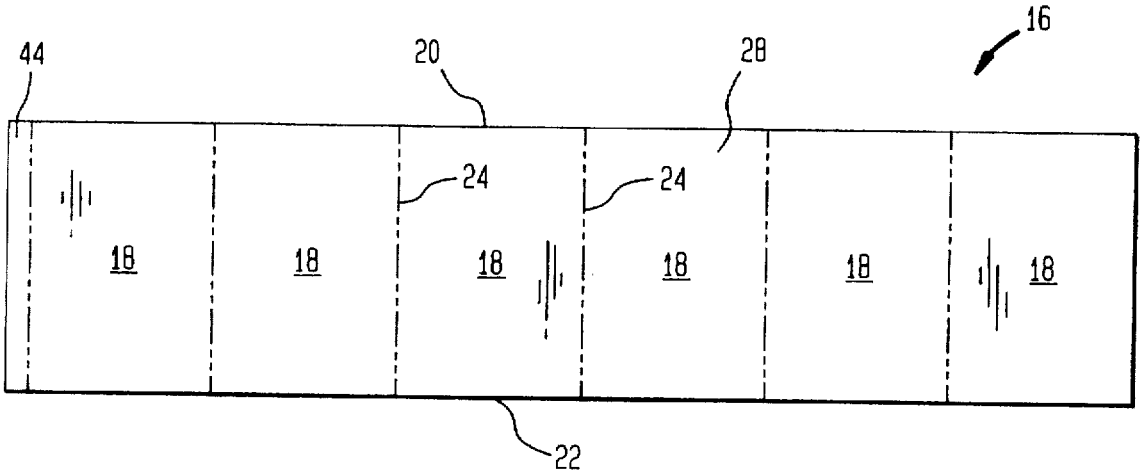
FIG. 4A illustrates the base sidewall section, including six identical sidewall panels and a longitudinal attachment tab, in the flat condition as seen from the outside.
Figure 4B:
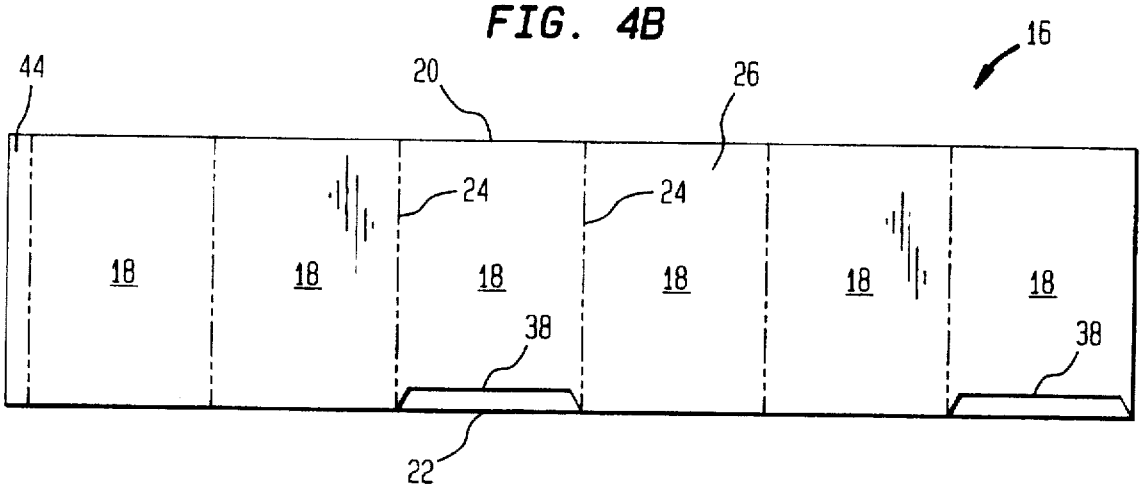
FIG. 4B illustrates the inside view of the base sidewall section of FIG. 4A in the flat state.

An exploded, erected view of the preferred embodiment of the invention 10 is illustrated in FIG. 1. The two principle parts of the improved multi-sided, semi-bulk container are a lower, container section 12 and upper cap section 14 which fits on top of the lower container section 12. The lower container section 12 includes a sidewall 16 formed having 6 sidewall panels 18 and a longitudinal sidewall attachment tab 44 as further seen in FIGS. 4A and 4B. Each of the six sidewall panels 18 includes a top edge 20, a bottom edge 22, and a pair of opposing side edges 24. FIG. 4A shows the outside surface 28 of the sidewall 16 when laid out in the flat. Conversely, FIG. 4B illustrates the inside surface 26 of the sidewall 16 when laid out in the flat. FIG. 4B also illustrates a cut-out portion 38 located at the bottom edge 22 of two of the sidewall panels 18. The cut-out portion 38 has a depth of approximately one-half of the thickness of the side-wall panel 18. In the case of a two-ply panel it would be the thickness of one-ply. Details of the cut-out section 38 may be more fully understood by reference to the discussion referring to FIGS. 3A, 3B and 3C. When longitudinal attachment tab 44 is glued to the edge of the panel 18 at the far end of the sidewall 16 it forms a hexagonal sidewall container 12 such as seen in FIG. 1.

Figure 4C:
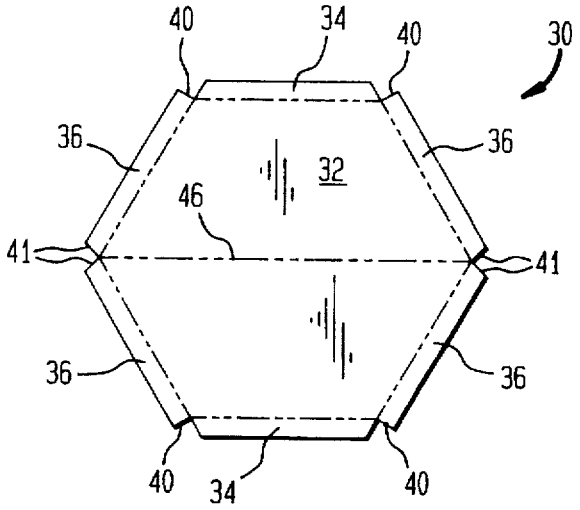
FIG. 4C illustrates the bottom section of the container with its associated tabs in the flat state prior to attachment to the cut-out portions of two opposed sidewall panels of the base section shown in FIG. 4B.

A bottom section 30 shown in the flat in FIG. 4C forms the floor of the lower container section 12. Bottom section 30 comprises a bottom panel 34, roughly divided in half by a bottom score, or fold, line 46. Bottom panel 32 is hexagonal in shape and includes six edges. Each of the six edges of the bottom panel 32 is attached to a tab 34 or 36. Two of the bottom tabs 34 are located on opposite sides of the bottom panel 32 and are glued respectively into the two cut-out portions 38 in two opposing panels 18 of the side-wall sections 16. Each of the attached tabs 34 has a nonattached tab 36 located on either side of it. Attached tabs 34 can be held in place in cut-out sections 38 by adhesives, preferably hot melt glue, or by mechanical fasteners such as staples, rivets or the like.

Figure 2:
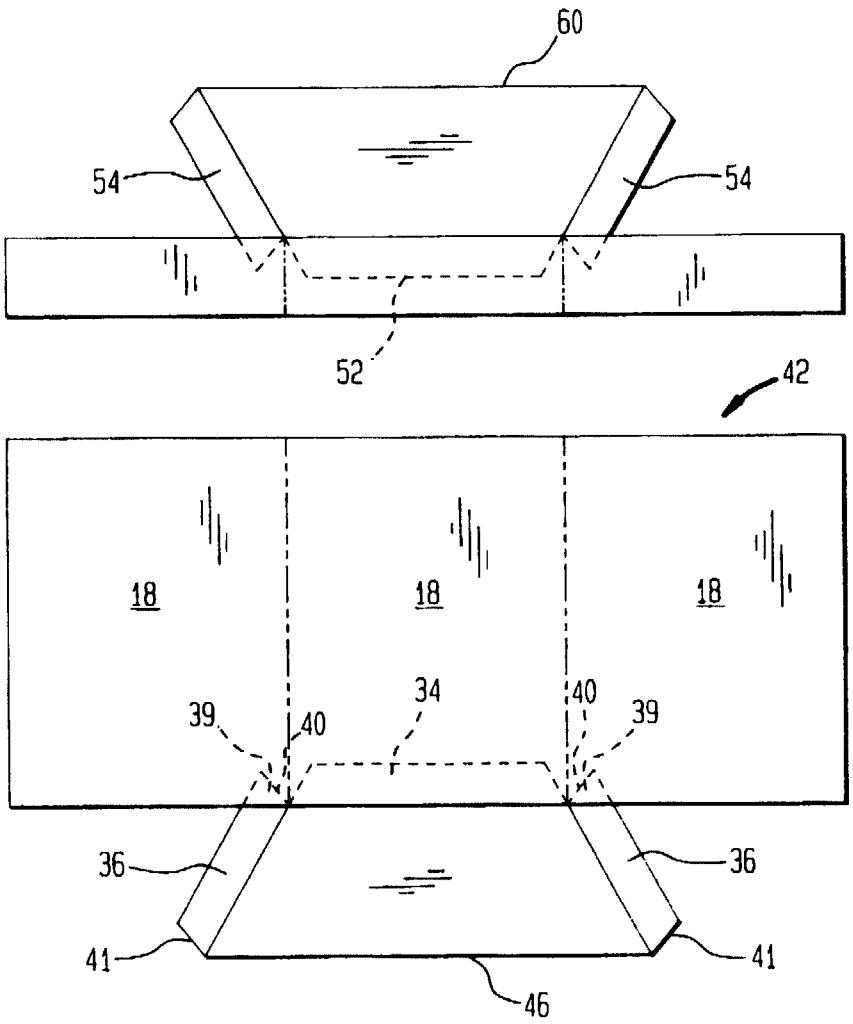
FIG. 2 illustrates the container, including its base section and the cap section, in the knockdown, flat state.

When the bottom tabs 34 are adhesively attached to the side-wall section 16 and longitudinal attachment tab 44 is attached to the extreme panel 18, preferably with hot melt glue 58, the resulting structure, when in the collapsed state 42 is shown in FIG. 2. A very important feature of the invention is that one edge 40 of each of the nonattached flaps 36 has a roughly 90 degree, i.e. perpendicular, relationship to the hexagonal edge of the bottom panel 32 so that a portion 39 of the tab 36 always remains inside of the collapsed sidewall when shown in the knocked down state 42 of FIG. 2. In addition, a portion 41 of each of the four nonattached tabs 36 opposite from the perpendicular portion 40 is tapered. This is important so that when the box is erected the adjacent portions 41 of each nonattached tabs 36 do not interfere with each other when going from the knocked down 42 to the erected state. Another important feature of the invention 10 also seen in FIGS. 3A, 3B, and 3C is that the cut-out portion 38 is of such a depth that it properly positions the nonattached tabs 36 with respect to the inside surface 26 of the sidewall panels 18 so that when the bottom panel 32 pops into position the tabs are properly tensioned.

Figure 5A:
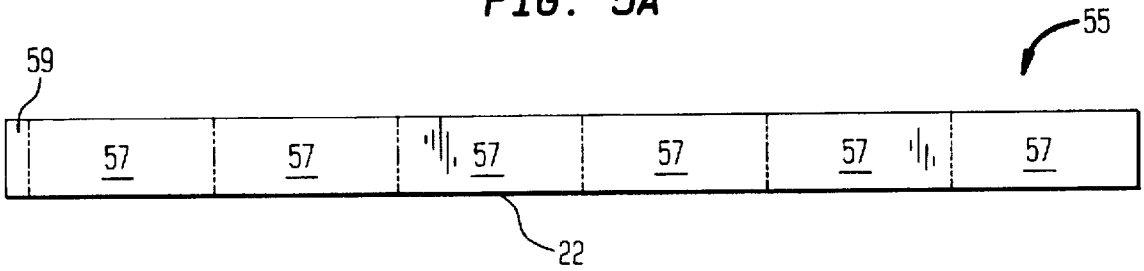
FIG. 5A illustrates the sidewall section of the cap in its flat, pre-constructed state as seen from the outside.
Figure 5B:
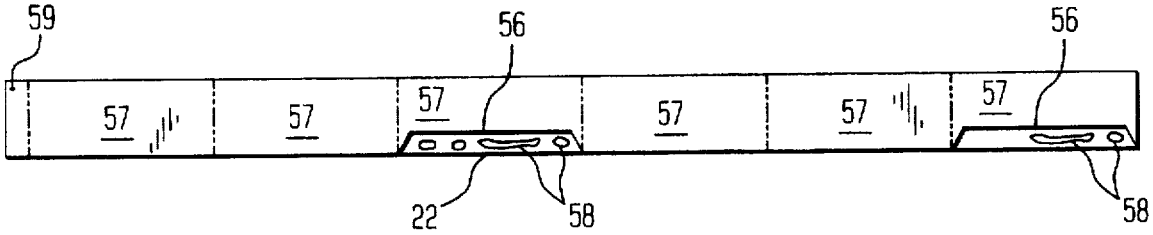
FIG. 5B illustrates the sidewall section of the cap illustrated in FIG. 5A in the flat condition as seen from the inside and before construction.
Figure 5C:
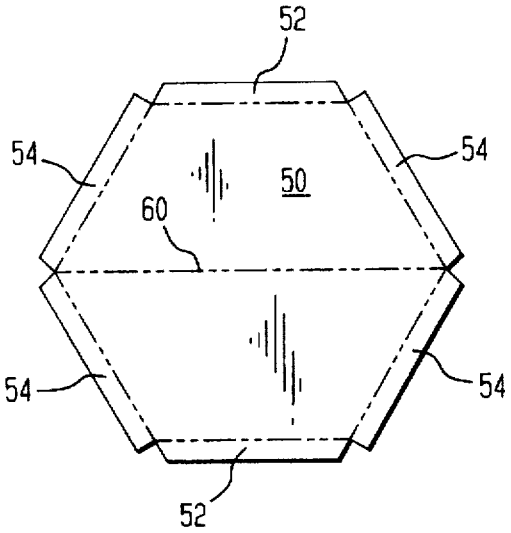
FIG. 5C illustrates the top panel of the cap with the associated tabs as seen in the flat, pre-constructed state.

The cap 14 has a structure very similar to that of the bottom container section 12 as shown in FIGS. 5A–5C. Cap 14 includes a top cap panel 50 including attachment tabs 52 and nonattached tabs 54. The attachment tabs 52 mate with a cut-out or indent section 56 in two of the six panels 57 of the cap sidewall section 55. A sidewall panel attachment tab 59 is adhesively attached to the furthest edge of the distal panel 57 in the same manner that tab 44 is attachable to distal panel 18. A portion of the nonattached tabs 54 always remains on the inside of the sidewall 55 when the cap 14 is in its flat, knocked down condition. The opposite edge of the nonattached cap tabs 54 is tapered so that the edges do not interfere with each other when the cap 14 changes from its collapsed to its erected state and vice versa. Needless to say, the inside circumference of an erected cap 14 is slightly larger than the outside circumference of the upper portion of the container section 12 when the cap 14 is placed on top of the container section 12. Hot melt adhesives 58 are preferably employed to attach the attachment tabs 52 to the cut-out section 56 of two of the cap panels 57. Alternatively, mechanical means such as rivets or staples could also be employed. The top cap panel 50 is divided in half by a score or fold line 60 in the same manner that score 46 divides the bottom panel 32 of the bottom section 30 in half.

FIGS. 6A–6E illustrate the manner in which the invention, according to its preferred embodiment 10, is erected.

Figure 6A:
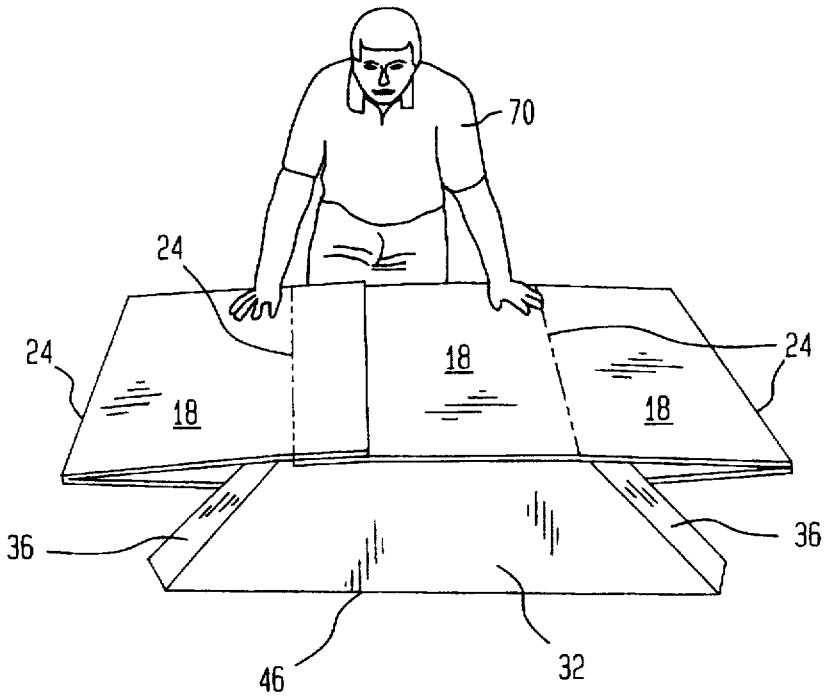
FIG. 6A illustrates how a worker might grab the container base section in the flat state prior to erection.

In FIG. 6A, a worker 70 is shown prior to grabbing the container in its flat state 42. The worker 70 might, for example, place his or her left hand near the top 20 of the two panels 18 at the edge 24 of the container, section 12. The right hand might be placed near the bottom 22 of the same two panels as illustrated in FIG. 6B.

Figure 6B:
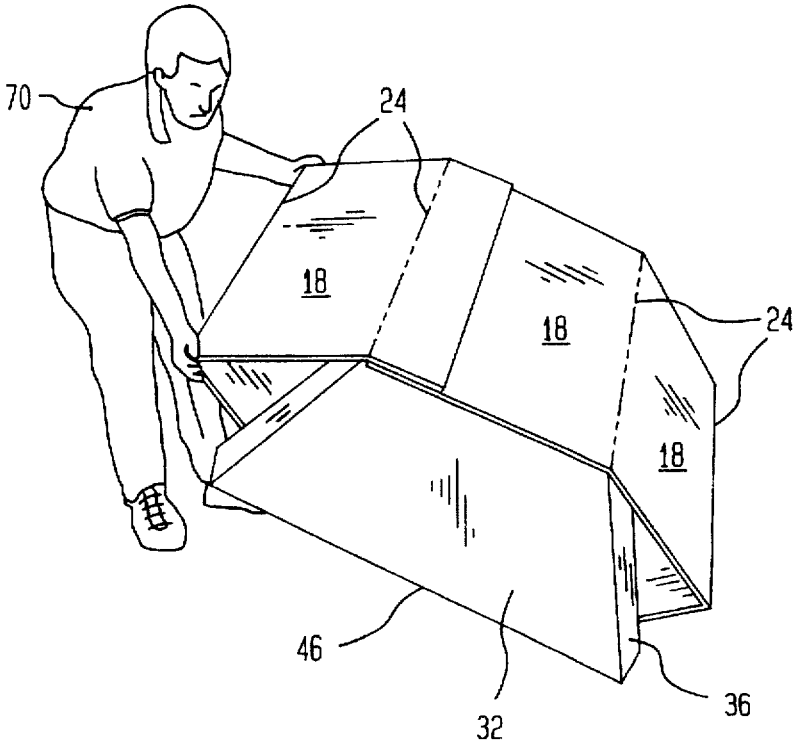
FIG. 6B illustrates the container part way through the erection process.

In FIG. 6B, the extreme edges of the container, or bottom section 12 are pushed towards each other, or the panels 18 are forced apart, by the worker 70 thereby causing the bottom panel 32 to move into the bottom of the sidewall section 16. Because the bottom section 30 is located outside of the container and, because portions 39 are always located inside the sidewall 16, the nonattached tabs 36 always automatically pop into position.

Figure 6C:
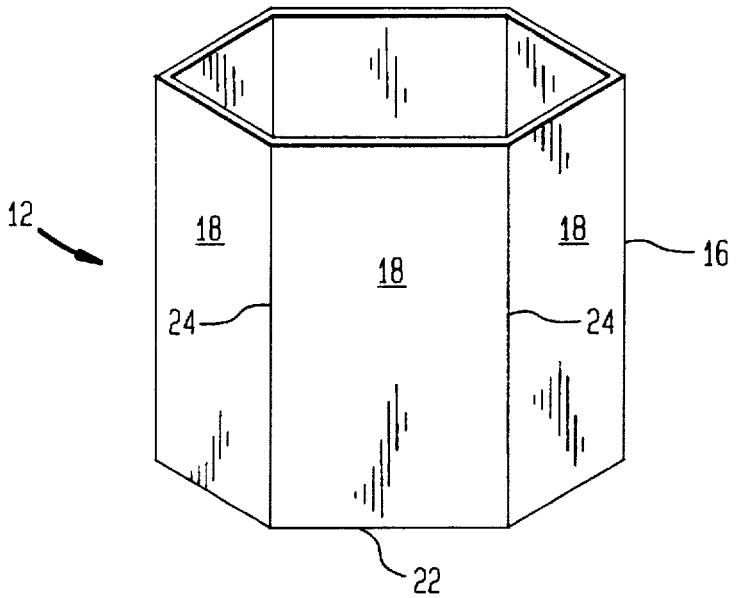
FIG. 6C illustrates the container base in its erected state.

FIG. 6C illustrates the base 12 in its virtually completely erected state. The unique structure and alignment of the nonattached tabs 36 caused them to pop automatically into position with respect to the bottom edges 22 of the nonattached panels 18. At this point in time, the worker 70 might place a plastic bag liner 62, seen in FIG. 1, into the container section 12 in order to permit the base to receive loose granular materials 64. It is not necessary to attach the nonattached tabs 36 to the remaining panels 18 because the container section 12 normally sits on a palette 66 and the rigidity of the basic structure is sufficient to keep the bottom section 30 from separating from the sidewall section 16.

Figure 6D:
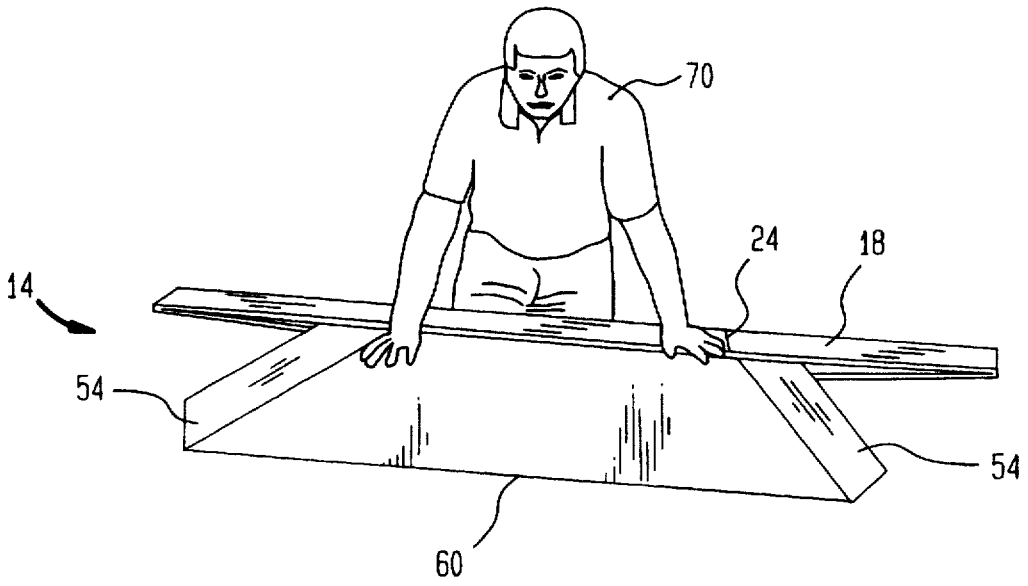
FIG. 6D illustrates the cap in its pre-erection state as grasped by a worker.
Figure 6E:
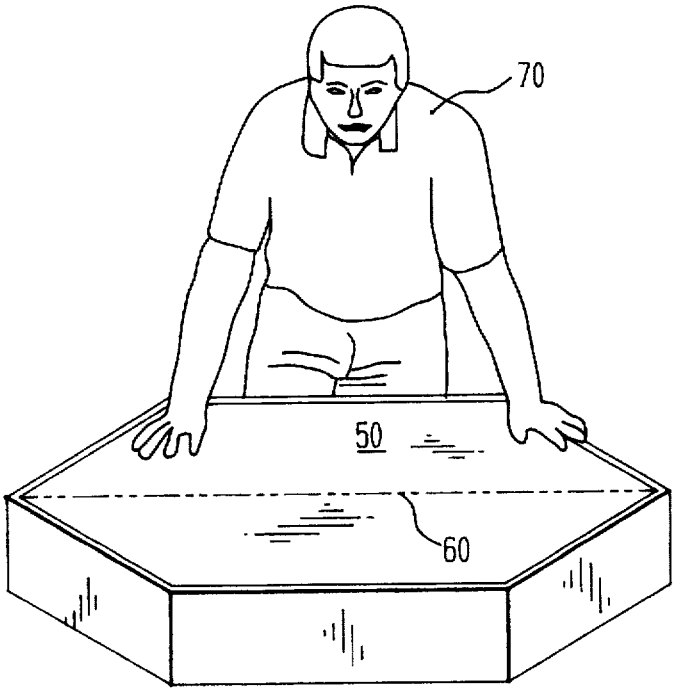
FIG. 6E illustrates the cap in its fully erected state.
Figure 6F:
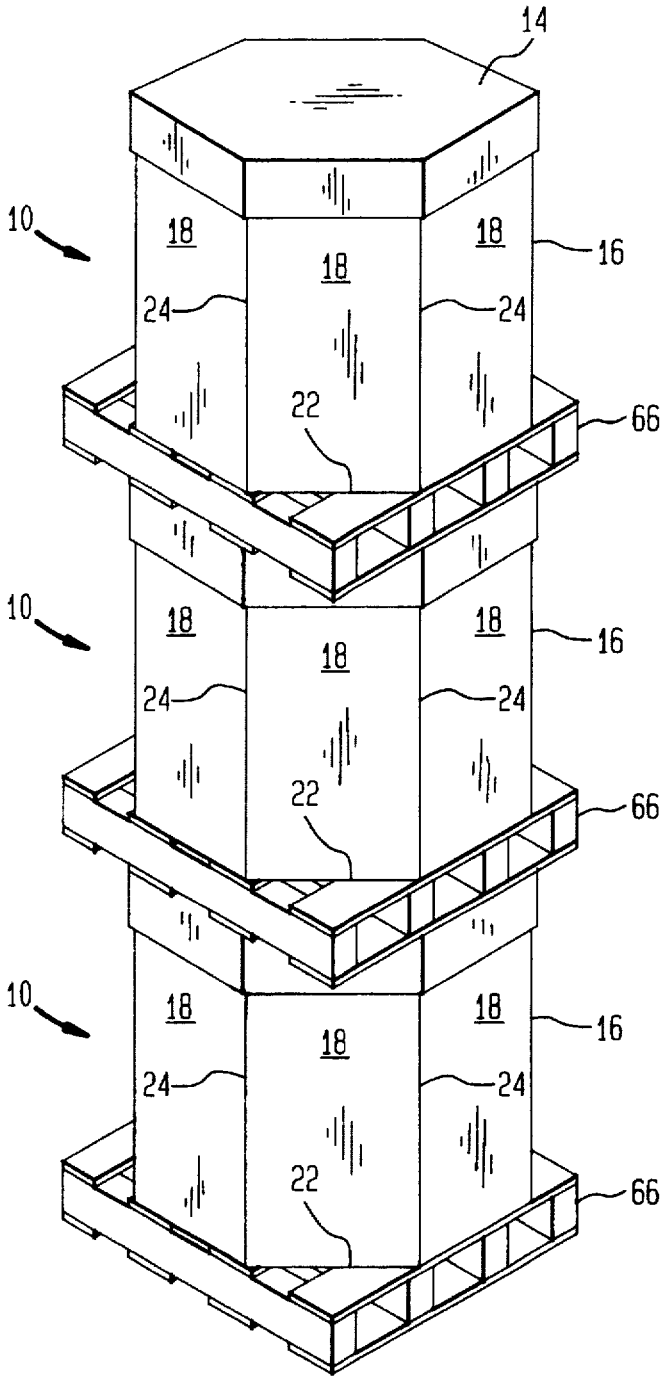
FIG. 6F shows the erected base and cap combined together as a unit, and placed on a pallet for stacking with other containers, with additional pallets separating the stacked containers from each other.

FIGS. 6D and 6E illustrate the manner in which the worker 70 next erects the cap section 14. The structure of the cap section 14 is, of course, parallel to, and substantially identical to, the structure of the lower container section 12 except that it is different in dimensions. As shown in FIG. 6D the worker 70 grabs the cap 14 by the top and bottom of the sidewall section 55 in such a way as to force the opposing panels 57 attached to the attached tabs 52 apart. This draws the top of panel 50 and the nonattached tabs 54 into proper position in the top sidewall 55. The cap 14 is then placed on the lower container section 12 as illustrated in FIGS. 1 and 6F after the container section 12, with plastic bag liner 62 in place, has been filled with materials 64. The materials can be, for example, a granular chemical resin or may be any other form of freely flyable materials.

The invention 10 lends itself especially well to a warehouse environment. The container section 12 in its erected state is typically placed upon a palette 66 which helps to keep the bottom panel 32 from sagging and the nonattached tabs 36 in position in the bottom of the container section 12. After the lower container section 12 is filled with materials 64, the cap section 14 is placed on top of it. Another palette 66 may be placed on top of the first container 10. The upper palette 66 could support a second multi-sided container 10 which, in turn, would be capped with another palette, etc. Multi-sided containers 10, separated by palette 66, can be stacked to a substantial height—perhaps as high as five or six containers 10.

The multi-sided container 10 has a number of important advantages over prior art devices.

First of all, it is a high performance and low cost invention that is relatively easy to assemble. No jigs are required; no automated equipment is required; no special pilots are required; no special strapping is required; no assembly of bottom caps is required; no separate bottom pads are required; no interlocking of bottom flaps is required; no top flanges are required. Because of the foregoing the possibility of Carpal Tunnel Syndrome (CTS) is reduced; material is used more strategically and economically; the cost per trailer load of units is reduced by as much as 30–40%; and, of course, there is less labor directly involved.

Another major advantage of the present invention 10 is that only one worker 70 is required and typical assembly time is 3–5 seconds per unit on line.

The assembled product has a completely sealed, flat, smooth bottom 32 due to the alignment of the nonattached bottom tabs 36 with the base of the lower container section 12. Because there are no overlapping flaps it is impossible for the openings to snag on deck boards and there is better distribution weight along the base. This gives rise to several other advantages. First of all, it is impossible for the containers 10 to leak in corners since there are no slots which can form "mouse holes" (slots are standard on rectangular totes with top flanges and bottom flaps). Second, the glued-in bottom tray of the present invention provides additional support at the critical 2–3 inches at the bottom of the tote.

Because of its relatively elegant design the bottom section 12 of the multi-sided container 10 can be collapsed from its erected state to its flat state in 1–2 seconds.

The structure of the improved multi-sided container 10 provides strength at strategically critical points such as the corners and side panels while, at the same time, not wasting paper and material on areas that are not structurally important, such as top flanges or bottom flaps. The container 10 has the advantage in that it places the corners and sides at the critical points of the palette which provides maximum support for the deck boards as well as the runners.

The perpendicular portion 40 of the nonattached tabs 36 which pop into the sidewall 16 are important because, in the erected state, the edges of the portions 40 come into contact with the inside edges 24 of the panels 18 and thereby directly reinforce edges 24 from the inside.

Another advantage of the present invention 10 is that two opposing side panels 18 are glued together in a unique manner as a male/female pattern which provides 100% consistent interlocking of the bottom component. This, in turn, prevents the tote 10 from spreading at the bottom, thereby creating a stronger tote especially when subjected to the following conditions: high heat and humidity which can cause weakening at the bottom of the tote, and ultimately spreading which ends in failure; under UN certification testing because of the severe nature of the UN drop test, most of the impact is at the corner of the tote 10 as well as at the bottom surface 32, however, the glued nature of the bottom panel 32 of the present invention significantly reduces, if not eliminates, the tendency of the tote 10 to open at the bottom under impact; and, since there are no longer any slots at the bottom 32 to spill open, any impact on the tote 10 no longer has the effect of tearing open the bottom 32 of the container 10 and providing an area for unloading, and, because of the "V" shaped corners of the multi-sided container 10, the product completely and quickly empties as compared to a conventional, prior art rectangular container.

In summary the present invention 10 exhibits substantial advantages in terms of cost, material usage, strength, and speed of assembly and disassembly, that are not exhibited by prior art structures and containers.

While the invention has been described with reference to a preferred embodiment thereof, it will be appreciated by those of ordinary skill in the art that changes can be made to the structure and parts of the invention without parting from the spirit and scope of the invention as a whole.

I claim:

1. A container apparatus which can be stored in a flat state and popped up into an erected state, said apparatus comprising:

a multi-sided, sidewall section having a top, a bottom, an inside and an outside and including at least six sidewall panels separated by fold lines, each sidewall panel having a top, a bottom, an inside, an outside, and a pair of opposing sides;

a bottom section having at least six sides;

at least six tabs connected to said at least six sides of the bottom section respectively, each tab including a fold line adjacent to where it meets said bottom section, wherein at least two of said tabs are attachable tabs attachable to two of said sidewall panels respectively and the remaining at least four tabs are unattached tabs;

attachment means for attaching said at least two attachable tabs to said sidewall panels, wherein a portion of said each of said at least four unattached tabs lies inside of said sidewall section and another portion of the same unattached tab lies outside of said sidewall section when said container is in the flat state and wherein all of said unattached tabs automatically slide into the bottom of said sidewall section when said container is erected.

2. The apparatus of claim 1 wherein the unattached tabs adjacent to the two attachable tabs include a first edge perpendicular to the sides of the base section and a second edge which is tapered with respect to the same side of said base section, wherein said portion of said unattached tabs adjacent to said two attachable tabs which lie inside of said sidewall section when said container apparatus is in said flat state comprise said first edge and wherein said second edge is tapered so that it does not interfere with adjacent tabs when said container changes from its flat state to its erected state.

3. The apparatus of claim 2 further comprising:

a pop up top for covering and partially surrounding the top of said multi-sided sidewall section.

4. The apparatus of claim 3 wherein said pop up top comprises:

a multi-sided, top sidewall section, having a top, a bottom, an inside and an outside and including at least six top panels each having a top, a bottom, an inside, and an outside and a pair of sides;

a top section having at least six sides;

at least six top tabs attached to at least six sides of the top section respectively, attachment means for attaching at least two of said top tabs to the top portion of at least two of said six top panels so that a portion of the top tabs adjacent to said attached top tabs lie inside of said sidewall section when said top is in the flat state, wherein said top tabs automatically slide into the top of said top sidewall section when said top is erected.

5. The apparatus of claim 4 wherein said sidewalls, panels, and tabs are formed from multi-ply corrugated paper.

6. The apparatus of claim 5 wherein said attachment means comprises an adhesive.

* * * * *